US008098020B2

(12) United States Patent
Langgaβner et al.

(10) Patent No.: US 8,098,020 B2
(45) Date of Patent: Jan. 17, 2012

(54) CIRCUIT ARRANGEMENT AND METHOD FOR OPERATING A DISCHARGE LAMP

(75) Inventors: Wolfgang Langgaβner, Bad Aibling (DE); Marcus Skatulla, Traunwalchen (DE)

(73) Assignee: Osram AG, Munich (DE)

( * ) Notice: Subject to any disclaimer, the term of this patent is extended or adjusted under 35 U.S.C. 154(b) by 683 days.

(21) Appl. No.: 12/226,278

(22) PCT Filed: Apr. 5, 2007

(86) PCT No.: PCT/EP2007/053396

§ 371 (c)(1),
(2), (4) Date: Dec. 4, 2008

(87) PCT Pub. No.: WO2007/118808

PCT Pub. Date: Oct. 25, 2007

(65) Prior Publication Data

US 2009/0289568 A1 Nov. 26, 2009

(30) Foreign Application Priority Data

Apr. 13, 2006 (DE) ..... 10 2006 017 521

(51) Int. Cl.
*H05B 37/02* (2006.01)

(52) U.S. Cl. ..... 315/291; 315/224

(58) Field of Classification Search ..... 315/291, 315/307, 246, 209 R, 200 R, 224, DIG. 2, 315/DIG. 5, DIG. 7
See application file for complete search history.

(56) References Cited

U.S. PATENT DOCUMENTS

| | | | | |
|---|---|---|---|---|
| 5,500,792 | A * | 3/1996 | Jeon et al. | 363/98 |
| 5,561,351 | A | 10/1996 | Vrionis et al. | |
| 6,133,697 | A | 10/2000 | Nagai et al. | |
| 6,683,418 | B2 * | 1/2004 | Shoji et al. | 315/224 |
| 6,768,271 | B2 | 7/2004 | Busse et al. | |
| 7,015,655 | B2 * | 3/2006 | Kamoi et al. | 315/291 |
| 7,282,867 | B2 * | 10/2007 | Maeda et al. | 315/224 |
| 2004/0160152 | A1 | 8/2004 | Onishi et al. | |
| 2004/0239262 | A1 | 12/2004 | Ido et al. | |

FOREIGN PATENT DOCUMENTS

| | | |
|---|---|---|
| EP | 1 326 485 | 7/2003 |
| JP | 63-245899 | 10/1988 |

* cited by examiner

*Primary Examiner* — Douglas W Owens
*Assistant Examiner* — Minh D A

(57) ABSTRACT

A circuit arrangement for operating a discharge lamp including an inverter, which at its output provides a signal with a preselectable frequency; at least one lamp inductance between the output of the inverter and the discharge lamp; at least one capacitor and, coupled to the lamp inductance, an actuating device for actuating the inverter with the signal; a control device for controlling a control parameter which is dependent on the lamp current, wherein the control device has a first time constant; wherein the discharge lamp has a second smaller time constant; the circuit arrangement has at least one area with a first and a second stable operating point and between these an unstable region of operation, and the actuating device varies the preselectable frequency during the operation of the discharge lamp in such a way that the circuit arrangement is operated in the unstable region of operation.

19 Claims, 5 Drawing Sheets

CIRCUIT ARRANGEMENT AND METHOD FOR OPERATING A DISCHARGE LAMP

TECHNICAL FIELD

The present invention relates to a circuit arrangement for operating a discharge lamp with an inverter, which is designed to provide a signal with a predeterminable frequency at its output, at least one terminal for the discharge lamp, at least one lamp inductor, which is coupled between the output of the inverter and the at least one terminal for the discharge lamp, at least one capacitor, which is coupled to the lamp inductor, a drive apparatus for driving the inverter with the signal with the predeterminable frequency, a control apparatus for controlling a control parameter, which is dependent on the lamp current, to a predeterminable value as a result of a change in the predeterminable frequency, the control apparatus having a first time constant, the discharge lamp having a second time constant, with which it reacts to a change in the predeterminable frequency with a change in a parameter which is dependent on the lamp current, the circuit arrangement, owing to the temperature-dependent UI characteristic of the discharge lamp and the frequency-dependent UI characteristic of a resonant circuit, which comprises at least the capacitor and the lamp inductor, having at least one range with a first and a second stable working point and, between the first and the second stable working point, an unstable working range in the family of UI characteristics. It also relates to a method for operating a discharge lamp using such a circuit arrangement.

PRIOR ART

In order to explain the problem on which the invention is based, reference is first made to the family of UI characteristics illustrated in FIG. 1, which reproduces the dependence of the lamp current $I_L$ and lamp voltage $U_L$ firstly on the frequency f at which the inverter is operated and secondly on the ambient temperature T. Since a discharge lamp is generally operated in the inductive mode so as to prevent switching losses, an increase in the frequency f at which the inverter is operated results in dimming, i.e. in a reduction in the lamp current or the power converted in the lamp. In the example illustrated in FIG. 1, the lowest frequency f corresponds to a frequency of 40 kHz, and the highest frequency f corresponds to a frequency of 72 kHz. If, for example, the temperature-dependent UI characteristic of the discharge lamp for T=35° C. is considered in FIG. 1, an increase Δf in the frequency f starting from a first stable working point $P_{35-1}$ results in a second stable working point $P_{35-2}$. This is because, in the case of the working point $P_{35-2}$, the temperature-dependent UI characteristic of the discharge lamp intersects the frequency-dependent UI characteristic of the resonant circuit at the point $P_{35-2}$, as a result of which a working point is defined which is characterized by a specific lamp current $I_L$ and by a specific lamp voltage $U_L$. This applies correspondingly to the temperature-dependent UI characteristic of the discharge lamp for T=20° C. and for any desired Δf. This is different for characteristics at a lower temperature; see, for example, the characteristic for T=10° C. in FIG. 1: starting from a working point $P_{10-2}$, a minimum increase in the frequency f no longer makes it possible for the lamp current and therefore the power to be reduced correspondingly to a minimum, but the stable working point $P_{10-4}$ is set suddenly (see the associated characteristic), which virtually corresponds to the discharge lamp extinguishing. The same problem in the opposite direction is found at the working point $P_{10-3}$. In this case, a minimum reduction in the frequency f results in a sudden jump in the working point $P_{10-5}$ and therefore an increase in the lamp current. Thus, the setting of a working point, such as, for example, of the point $P_{10-1}$ positioned between the points $P_{10-2}$ and $P_{10-3}$, and therefore continuous dimming in this range is only made even more difficult, and often even no longer possible at all.

FIG. 2 shows the profile over time of the lamp current $I_L$, the lamp voltage $U_L$ and a voltage $U_f$, which is correlated with the frequency f. In the example illustrated, the time constant of the lamp was 10 μs, while the control apparatus was configured as a digital control apparatus with a time constant of 50 μs. As can be seen from this illustration, keeping the frequency f constant, which corresponds to keeping the voltage $U_f$ constant, results in the discharge lamp being extinguished, as can be seen from the current $I_L$ decreasing and the voltage $U_L$ increasing. It can furthermore be seen that the control apparatus only reacts with a frequency reduction when the discharge lamp has already been extinguished. This results in restarting of the discharge lamp, but this results in the discharge lamp being extinguished again within approximately 950 μs.

A control apparatus which is suitable for operating the lamp in the unstable working range is characterized in the prior art by virtue of the fact that the control takes place more rapidly than the lamp can react as a result of its inertia. With reference once again to the characteristic for T=10° C. in FIG. 1, a control apparatus would, starting from the working point $P_{10-2}$, first increase the frequency f in order to operate the discharge lamp, for example, at the point $P_{10-1}$. Thereupon, on account of its inertia, the discharge lamp does not reduce the lamp current or its power suddenly, but continuously, i.e. with a specific time constant, in order to achieve the working point $P_{10-4}$. If the control apparatus notices that the lamp current to be set for the point $P_{10-1}$, has been undershot, it lowers the frequency until the lamp current to be set is exceeded again and therefore the frequency is increased again. If the control apparatus is quick enough, the discharge lamp is operated dynamically within a small working range around the working point $P_{10-1}$. As the control speed decreases, the working range thus covered becomes ever greater until finally two stable working points are achieved. The greater this working range is, the greater the crest factor of the lamp current is, which results in premature ageing of the lamp. Moreover, flicker phenomena can occur.

If the control apparatus is quick enough, it is possible for the lamp to be operated in the desired working range between two stable working points, which are dependent on the frequency f. The required desired working range can accordingly be set if a control apparatus is used whose time constant is markedly smaller than the time constant which is predetermined by the discharge lamp, i.e. with which the discharge lamp reacts to a change in the frequency with a change in the lamp current or the lamp power. An alternative for preventing the lamp from extinguishing or for preventing operation in the unstable working range consists in the dimming range of the discharge lamp being given a lower limit, for example being limited to 3, 10 or 30% of the maximum power converted in the lamp.

Quick control apparatuses, regardless of whether they are analog or digital, consume more energy, have a complex design and are therefore expensive.

DESCRIPTION OF THE INVENTION

The object of the present invention therefore consists in developing the circuit arrangement mentioned at the outset or the method mentioned at the outset in such a way that the operation of a discharge lamp in the desired working range is also made possible with slower and thus less expensive control apparatuses.

This object is achieved by a circuit arrangement having the features of patent claim 1 and by a method having the features of patent claim 14.

The present invention is based on the knowledge that the operation with slow control apparatuses, i.e. with control apparatuses which have a time constant which is greater than or equal to the time constant which is predetermined by the reaction time of the discharge lamp for a frequency change is made possible if the drive apparatus is designed to vary the frequency at which the inverter is operated constantly, i.e. continuously and/or in sudden jumps, to be precise in such a way that the circuit arrangement is operated in the unstable working range. The invention is based furthermore on the knowledge that, as a result of the frequency changes according to the invention, virtually artificial slowing of the reaction time of the lamp in the region of the unstable desired working range is achieved, as a result of which slower control apparatuses are given more time to determine the manipulated variable before one of the undesirable stable working points is reached. The manipulated variables of the control apparatus can be, for example, the lamp power P, the lamp voltage $U_L$ or the lamp current $I_L$. In the context of the circuit arrangements according to the invention, the control apparatus, with a view to varying the frequency over time, preferably controls the system so as to ascertain the corresponding mid values.

A large number of implementations are possible for the type of variation of the frequency: In this case, the optimum periods for which the inverter is driven at the respective frequency are dependent on the reaction time of the lamp. If, as has been mentioned, the time constant of the lamp is smaller than the period between two frequency changes, the stable working points can be set. If the time constant of the lamp is greater than the period between two frequency changes, the stable working points are no longer reached, with the working range of the lamp moving ever closer around the desired working point within the unstable working range as the change speed increases, i.e. as the period during which the respective frequency is applied becomes shorter. With respect to the unstable working point $P_{10-1}$, see FIG. 1, the latter is no longer fixedly assumed, but is constantly exceeded and undershot. In other words: If the changes take place so quickly that the lamp can no longer follow them owing to its inertia, toppling into a stable working point is no longer possible.

If the desired value of the control parameter is changed, accordingly in a simple exemplary embodiment in which the system is switched to and fro between two frequencies, the mid frequency is changed, which then affects the two actual operating frequencies at which the lamp is operated.

In a preferred exemplary embodiment, accordingly the drive apparatus is designed to operate the discharge lamp at least during a first period at a first predeterminable frequency and at least during a second period at a second predeterminable frequency. As an extension of the exemplary embodiment, it is of course possible that the drive apparatus is designed to operate the discharge lamp during at least one further period at least one further predeterminable frequency. This includes the case of operating the discharge lamp with a large number of predeterminable frequencies, it being possible for the associated periods to be equal or unequal. In this case, it is preferred if the periods are repeated cyclically. The drive apparatus can also be designed to keep the periods, which are associated with specific predeterminable frequencies, constant during operation of the discharge lamp or to vary them. Preferably, the drive apparatus is designed to vary the predeterminable frequency (frequencies) in such a way that operation of the discharge lamp at a stable working point is prevented. This makes it possible for the lamp to be operated in the desired unstable working range between the two stable working points. As an alternative or in addition to the variation of the predeterminable frequency (frequencies), the period(s) can be varied correspondingly, with the result that operation of the discharge lamp at a stable working point is prevented.

In particular, it is preferred if the drive apparatus is designed to vary the predeterminable frequency (frequencies) and/or the period(s) in such a way that the set working point moves dynamically between the first and the second stable working point.

The control parameter of the control apparatus is preferably the actual value of the lamp current and/or the actual value of the lamp power and/or the actual value of the lamp voltage. The control apparatus is preferably designed for supplying a dimming signal, which corresponds to a desired value of the lamp current or of the lamp power or the lamp voltage, a table or a formulaic relationship being associated with the control apparatus, with the result that the predeterminable frequencies and/or the predeterminable periods can be provided on the basis of at least the dimming signal and the actual value of the lamp current or the lamp power or the lamp voltage. In this case, it is particularly preferred if the table or the formulaic relationship furthermore takes into account the crest factor.

In preferred embodiments of circuit apparatuses according to the invention, the control apparatus is designed to function with an increment of 10 μs or more, in particular with an increment of 50 μs.

Further advantageous embodiments are given in the dependent claims.

The preferred embodiments proposed with reference to the circuit arrangement according to the invention and the advantages thereof apply correspondingly, insofar as applicable, to the method according to the invention for operating a discharge lamp.

BRIEF DESCRIPTION OF THE DRAWING(S)

An exemplary embodiment of the invention will be described in more detail below with reference to the attached drawings, in which.

Figure 4:
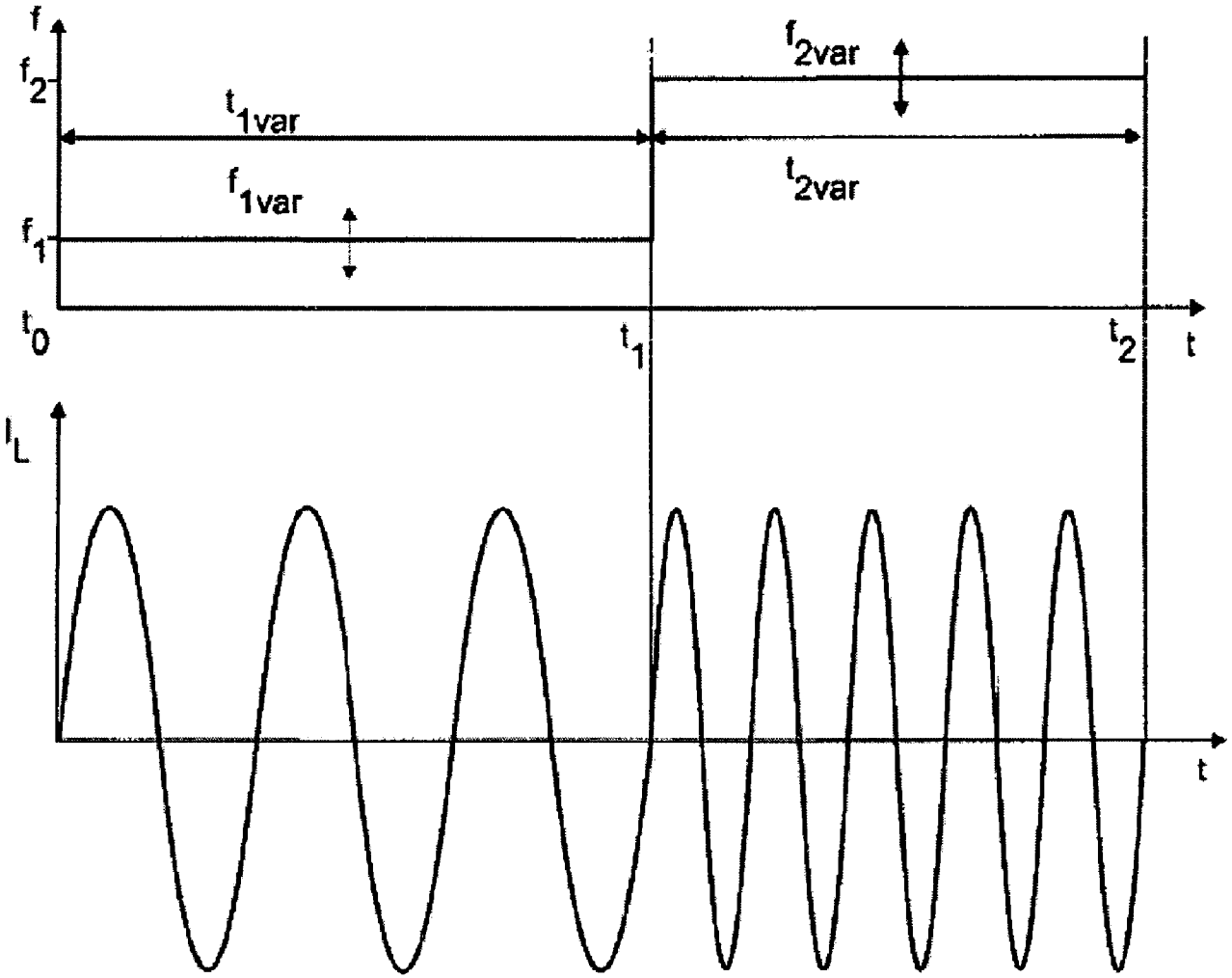
Figure 5:
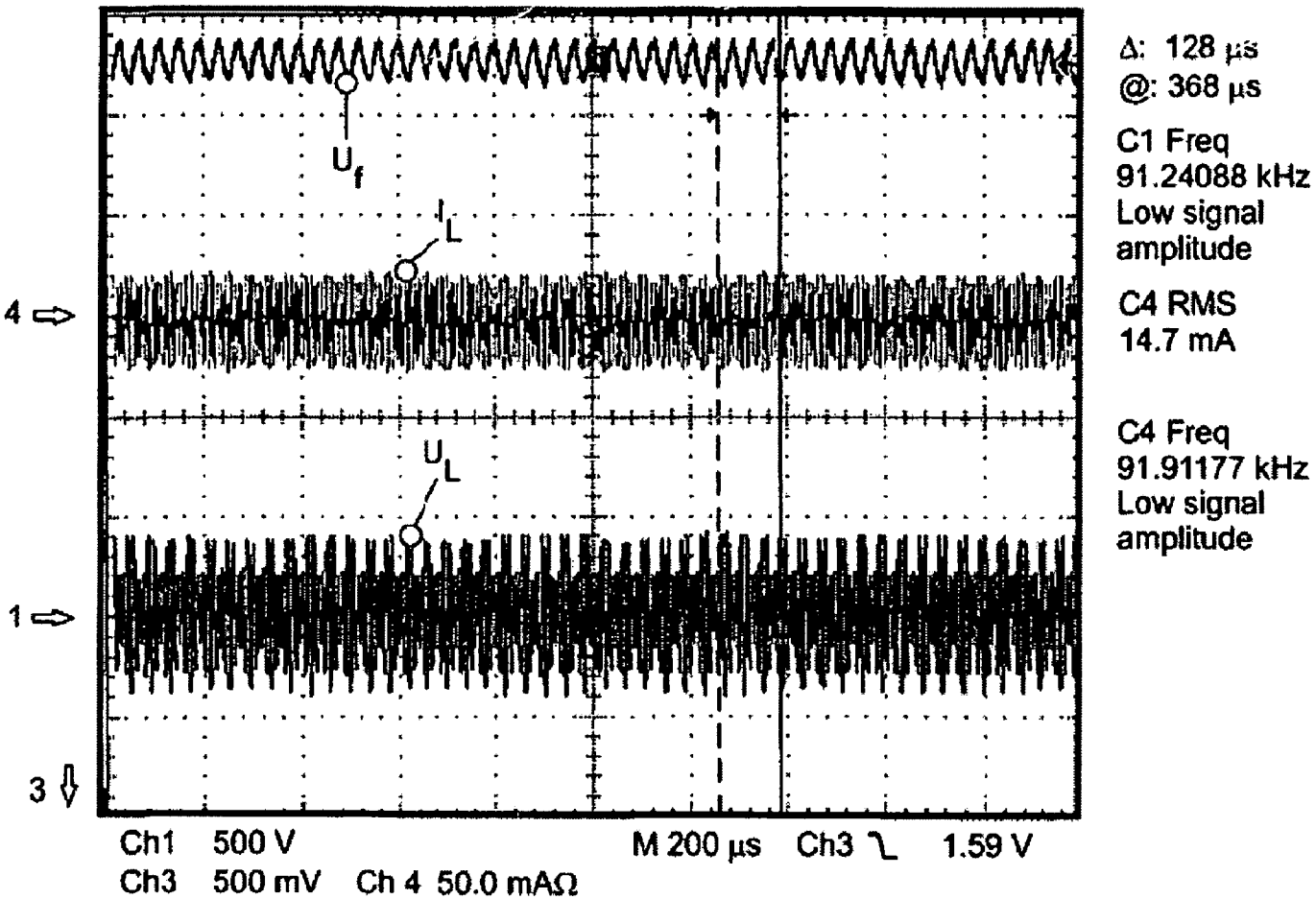

FIG. 4 shows the variation of the frequency over time and the corresponding profile over time of the lamp current $I_L$ in an exemplary embodiment of the circuit arrangement according to the invention; and FIG. 5 shows the profile over time of the lamp current $I_L$, the lamp voltage $U_L$ and a voltage $U_f$, which is correlated with the frequency f, in an exemplary embodiment of a circuit arrangement according to the invention.

PREFERRED EMBODIMENT OF THE INVENTION

Figure 3:
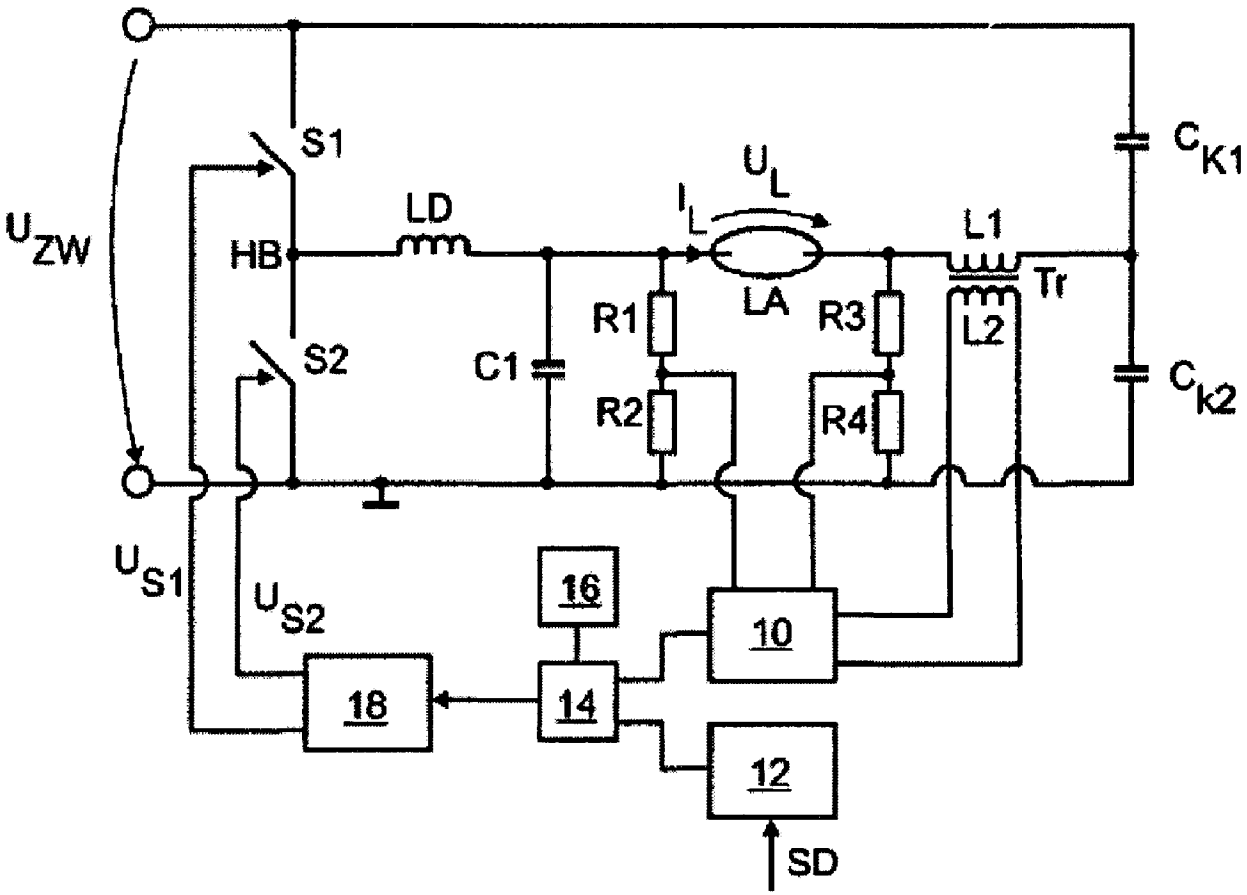
FIG. 3 shows a schematic illustration of the construction of an exemplary embodiment of a circuit arrangement according to the invention.

FIG. 3 shows a schematic illustration of the construction of an exemplary embodiment of a circuit arrangement according to the invention. In this case, the so-called intermediate circuit voltage $U_{ZW}$ is present across the series circuit comprising the two switches S1, S2 in a half-bridge arrangement. This intermediate circuit voltage $U_{ZW}$ is, depending on the embodiment, approximately 100 to 450 V and is generally produced from the system voltage via a rectifier and a smoothing capacitor. The half-bridge mid point HB is connected to a first terminal of the lamp LA via a lamp inductor $L_D$. Moreover, a capacitor C1, which, together with the lamp inductor $L_D$, forms a resonant circuit and is designed in particular to start the lamp LA, is connected to this terminal. The current flowing through the lamp LA is denoted by $I_L$, and the voltage drop across the lamp is denoted by $U_L$. The other terminal of the lamp LA is connected, via the primary inductance L1 of a transformer Tr, firstly to the intermediate circuit voltage $U_{ZW}$ via a coupling capacitor $C_{K1}$, and secondly to a reference potential, in this case ground, via a coupling capacitor $C_{K2}$. The first lamp terminal is connected to the reference potential via a first voltage divider comprising the resistors R1 and R2, and the second terminal of the lamp LA is connected to the reference potential via a second voltage divider comprising the resistors R3 and R4. The respective taps of the two voltage dividers are connected to a measuring apparatus 10 for the purpose of determining a voltage, which is correlated with the lamp voltage $U_L$. Said measuring apparatus 10 measures, in addition to the actual value of the voltage $U_L$ across the lamp LA, by means of evaluating the signal provided by the secondary inductance L2 of the transformer Tr, the actual value of the lamp current $I_L$. The measuring apparatus 10 can furthermore be designed to determine the power P converted in the lamp from the lamp current $I_L$ and the lamp voltage $U_L$. Moreover, the crest factor can be determined from the lamp current $I_L$. One of a plurality of alternatives for determining the lamp power consists in coupling a shunt resistor between the switch S2 of the half-bridge arrangement and the reference potential and using the voltage drop across this shunt resistor to calculate the power converted in the lamp.

A reference value apparatus 12 provides a desired value for the lamp current $I_L$ and/or for the lamp voltage $U_L$ and/or for the lamp power P, to be precise in dependence on a dimming signal $S_D$ supplied via an interface. A comparison apparatus 14, which is supplied the actual value of the corresponding variable(s) $I_L$, $U_L$, P via the measuring apparatus 10 and the corresponding desired value via the reference value apparatus 12, ascertains from a table 16, in dependence on these values, the frequencies at which and the periods associated with the respective frequencies for which the switches S1, S2 of the half-bridge arrangement are to be driven. Instead of a table, a corresponding formulaic relationship can also be associated with the comparison apparatus 14. This information is provided to the drive apparatus 18, which thereupon correspondingly drives the switches S1, S2, in particular cyclically and repeatedly up to a change in the signal $S_D$.

FIG. 4 shows, for a simple exemplary embodiment, the sequence over time of the frequency variation. During the period $t_1$ minus $t_0$, the switches S1, S2 of the half-bridge are operated at a frequency $f_1$, and, during the period $t_2$ minus $t_1$, at a frequency $f_2$. This variation in the frequency is reflected in the temporal profile of the lamp current $I_L$, as illustrated in FIG. 4: during the period $t_1$ minus $t_0$, the lamp current $I_L$ has the frequency $f_1$, and during the period $t_2$ minus $t_1$ it has the higher frequency $f_2$. As identified at the top in the illustration in FIG. 4, both the periods $t_1$ and $t_2$ can be varied, as well as the frequencies $f_1$ and $f_2$.

As has already been mentioned further above, the invention also includes adding further frequencies and corresponding periods. In this case, in particular also a constant variation of the frequency (corresponding to an infinitesimally small period associated with any individual frequency) is also included. In particular, frequencies can also be selected which would mean that the lamp is extinguished during steady-state operation.

Figure 1:
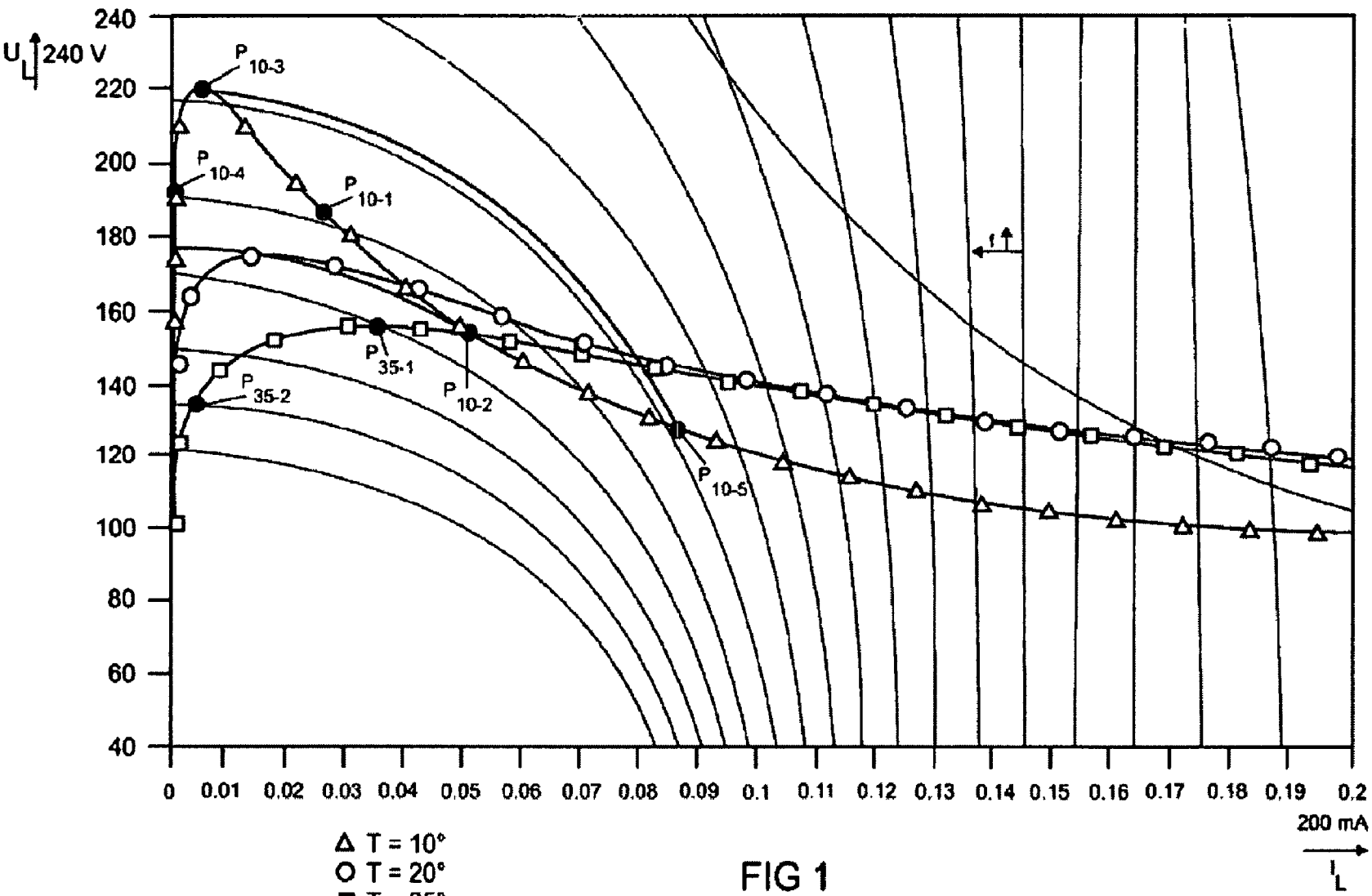
FIG 1 (Prior art)
FIG. 1 shows a family of UI characteristics, in which three temperature-dependent UI characteristics of a discharge lamp and a large number of frequency-dependent UI characteristics of a resonant circuit of a circuit arrangement known from the prior art for operating a discharge lamp are illustrated.
Figure 2:
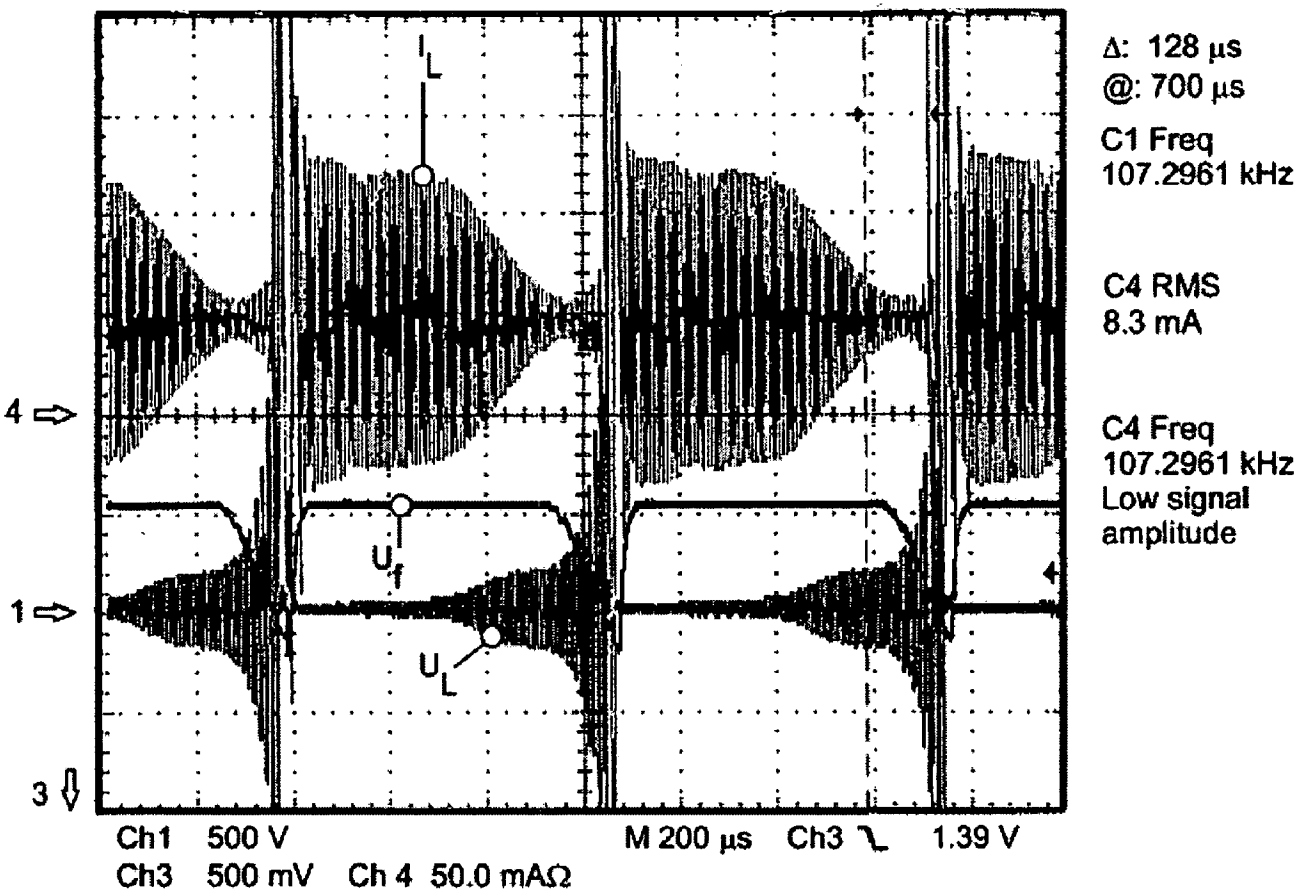
FIG 2 (Prior art)
FIG. 2 shows the profile over time of the lamp current $I_L$, the lamp voltage $U_L$ and a voltage $U_f$, which is correlated with the frequency f, in the case of a circuit arrangement known from the prior art.

FIG. 5 shows the profile over time of the lamp current $I_L$, the lamp voltage $U_L$ and a voltage $U_f$, which is correlated with the frequency f, for an exemplary embodiment of a circuit arrangement according to the invention. Although the profile over time of the voltage $U_f$ is represented as a delta-wave profile, it is actually a square-wave profile. The delta-wave profile results from the limited edge gradient of the D/A converter used in the exemplary embodiment. A comparison with FIG. 2, in which the lamp current $I_L$ is represented with the same resolution, shows that stable operation is now made possible with a markedly lower current $I_L$ of 14.7 mA. While, in the exemplary embodiment in FIG. 5, the frequency was alternated between approximately 91 kHz and 101 kHz, the frequency was approximately 107 kHz in the example in FIG. 2.

The invention claimed is:

1. A circuit arrangement for operating a discharge lamp (LA) with an inverter, which is designed to provide a signal ($S_D$) with a predeterminable frequency at its output;

at least one terminal for the discharge lamp (LA), at least one lamp inductor ($L_D$), which is coupled between the output of the inverter and the at least one terminal for the discharge lamp (LA);

at least one capacitor ($C_l$), which is coupled to the lamp inductor ($L_D$);

a drive apparatus (18) for driving the inverter with the signal ($S_D$) with the predeterminable frequency;

a control apparatus (10, 12, 14, 16) for controlling a control parameter, which is dependent on the lamp current ($I_L$), to a predeterminable value as a result of a change in the predeterminable frequency, the control apparatus (10, 12, 14, 16) having a first time constant;

the discharge lamp (LA) having a second time constant, with which it reacts to a change in the predeterminable frequency with a change in a parameter which is dependent on the lamp current ($I_L$);

the circuit arrangement, owing to the temperature-dependent UI characteristic of the discharge lamp (LA) and the frequency-dependent UI characteristic of a resonant circuit, which comprises at least the capacitor ($C_l$) and the lamp inductor ($L_D$), having at least one range with a first and a second stable working point and, between the first and the second stable working point, an unstable working range in the family of UI characteristics, characterized in that the first time constant is greater than or equal to the second time constant; and the drive apparatus (18) is designed to vary the predeterminable frequency during the operation of the discharge lamp (LA) in such a way that the circuit arrangement is operated in the unstable working range.

2. The circuit apparatus as claimed in claim 1, characterized in that the drive apparatus (18) is designed to operate the discharge lamp (LA) at least during a first period ($t_1$) at a first predeterminable frequency ($f_1$) and at least during a second period ($t_2$) at a second predeterminable frequency ($f_2$).

3. The circuit arrangement as claimed in claim 2, characterized in that the drive apparatus (18) is designed to operate the discharge lamp (LA) during at least one further period at a further predeterminable frequency.

4. The circuit apparatus as claimed in claim 3, characterized in that the drive apparatus (18) is designed to cyclically repeat the periods.

5. The circuit apparatus as claimed in claim 2, characterized in that the drive apparatus (18) is designed to cyclically repeat the periods.

6. The circuit apparatus as claimed in of claim 2, characterized in that the periods are equal or unequal.

7. The circuit apparatus as claimed in of claim 2, characterized in that the drive apparatus (18) is designed to keep the periods ($t_1$; $t_2$), which are associated with specific predeterminable frequencies ($f_1$; $f_2$), constant during operation of the discharge lamp (LA) or to vary them.

8. The circuit apparatus as claimed in claim 2, characterized in that the drive apparatus (18) is designed to vary the predeterminable frequency (frequencies) in such a way that operation of the discharge lamp (LA) at a stable working point is prevented.

9. The circuit apparatus as claimed in claim 1, characterized in that the drive apparatus (18) is designed to vary the predeterminable frequency (frequencies) in such a way that operation of the discharge lamp (LA) at a stable working point is prevented.

10. The circuit apparatus as claimed in claim 9, characterized in that the drive apparatus (18) is designed to vary the predeterminable frequency (frequencies) ($f_1$; $f_2$) and/or the period(s) ($t_1$; $t_2$) in such a way that the set working point moves dynamically between the first and the second stable working point.

11. The circuit apparatus as claimed in of claim 2, characterized in that the drive apparatus (18) is designed to vary the period(s) ($t_1$; $t_2$) in such a way that operation of the discharge lamp (LA) at a stable working point is prevented.

12. The circuit apparatus as claimed in claim 11, characterized in that the drive apparatus (18) is designed to vary the predeterminable frequency (frequencies) ($f_1$; $f_2$) and/or the period(s) ($t_1$; $t_2$) in such a way that the set working point moves dynamically between the first and the second stable working point.

13. The circuit apparatus as claimed in claim 1, characterized in that the control parameter of the control apparatus (10, 12, 14, 16) is the actual value of the lamp current ($I_L$) and/or the actual value of the lamp power (P) and/or the actual value of the lamp voltage ($U_L$).

14. The circuit apparatus as claimed in claim 13, characterized in that the control apparatus (10, 12, 14, 16) is designed for supplying a dimming signal ($S_D$), which corresponds to a desired value of the lamp current ($I_L$) or of the lamp power (P) or the lamp voltage ($U_L$), a table (16) or a formulaic relationship being associated with the control apparatus (10, 12, 14, 16), with the result that the predeterminable frequencies ($f_1$, $f_2$) and/or the predeterminable periods ($t_1$, $t_2$) can be provided on the basis of at least the dimming signal ($S_D$) and the actual value of the lamp current ($I_L$) or the lamp power (P) or the lamp voltage ($U_L$).

15. The circuit apparatus as claimed in claim 14, characterized in that the table (16) or the formulaic relationship furthermore takes into account the crest factor.

16. The circuit apparatus as claimed in claim 15 characterized in that the control apparatus (10, 12, 14, 16) is designed to function with an increment of 10 μs or more, in particular with an increment of 50 μs.

17. The circuit apparatus as claimed in claim 14, characterized in that the control apparatus (10, 12, 14, 16) is designed to function with an increment of 10 μs or more, in particular with an increment of 50 μs.

18. The circuit apparatus as claimed in claim 13, characterized in that the control apparatus (10, 12, 14, 16) is designed to function with an increment of 10 μs or more, in particular with an increment of 50 μs.

19. A method for operating a discharge lamp (LA) using a circuit arrangement with an inverter, which is designed to provide a signal ($S_D$) with a predeterminable frequency at its output, at least one terminal for the discharge lamp (LA), at least one lamp inductor ($L_D$), which is coupled between the output of the inverter and the at least one terminal for the discharge lamp (LA), at least one capacitor ($C_l$), which is coupled to the lamp inductor ($L_D$), a drive apparatus (18) for driving the inverter at the predeterminable frequency, a control apparatus (10, 12, 14, 16) for controlling a control parameter, which is dependent on the lamp current ($I_L$), to a predeterminable value as a result of a change in the predeterminable frequency, the control apparatus (10, 12, 14, 16) having a first time constant, the discharge lamp (LA) having a second time constant, with which it reacts to a change in the predeterminable frequency with a change in a parameter which is dependent on the lamp current ($I_L$), the circuit arrangement, owing to the temperature-dependent UI characteristic of the discharge lamp (LA) and the frequency-dependent UI characteristic of a resonant circuit, which at least comprises the capacitor ($C_l$) and the lamp inductor ($L_D$), having at least one region with a first and a second stable working point and, between the first and the second stable working point, an unstable working range in the family of UI characteristics, characterized in that the first time constant is greater than or equal to the second time constant; and the predeterminable frequency is varied during the operation of the discharge lamp (LA) in such a way that the circuit arrangement is operated in the unstable working range.

* * * * *